US007258564B1

(12) United States Patent
Su

(10) Patent No.: US 7,258,564 B1
(45) Date of Patent: Aug. 21, 2007

(54) ASSEMBLY-TYPE FEMALE CONNECTOR

(75) Inventor: Tun-Li Su, Kaohsiung Hsien (TW)

(73) Assignee: Gem Terminal Ind. Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 11/606,043

(22) Filed: Nov. 30, 2006

(30) Foreign Application Priority Data

Jan. 18, 2006 (TW) ..... 95201106 U

(51) Int. Cl.
*H01R 4/50* (2006.01)
*H01R 13/625* (2006.01)

(52) U.S. Cl. ..... 439/346; 439/337

(58) Field of Classification Search ..... 439/337, 439/346, 139
See application file for complete search history.

(56) References Cited

U.S. PATENT DOCUMENTS 4,548,455 A * 10/1985 Ezure ..... 439/152
5,046,961 A * 9/1991 Hoffman ..... 439/141
5,234,355 A * 8/1993 Sosinski et al. ..... 439/337
5,286,213 A * 2/1994 Altergott et al. ..... 439/139
5,921,799 A * 7/1999 Forrester ..... 439/346
5,967,815 A * 10/1999 Schlessinger et al. ..... 439/188
6,220,885 B1 * 4/2001 Lemberger et al. ..... 439/346
6,619,975 B2 * 9/2003 Bentley et al. ..... 439/346
6,896,537 B2 * 5/2005 Burton ..... 439/346

* cited by examiner

*Primary Examiner*—Michael C. Zarroli
(74) *Attorney, Agent, or Firm*—Rosenberg, Klein & Lee

(57) ABSTRACT

An assembly-type female connector is generally comprised of an internal frame body and a group of socket terminals. The internal frame body comprises a main body, a lateral cover, and an outer cover, wherein at least two first slots are formed on the outside of the main body. The outer cover is composed of at least two independent segments, wherein each segment has an inwardly extended first wall and an inwardly extended second wall for insertion into the first slots of the main body, respectively, whereby the first walls of the segments and the second walls of the segments can be jointly, tightly inserted into the first slots of the main body. As a result, the outer cover and the main body can be assembled to each other, and the integral structure has a detachable tight assemblage.

5 Claims, 4 Drawing Sheets

A-A

ASSEMBLY-TYPE FEMALE CONNECTOR

FIELD OF THE INVENTION

The present invention relates to a female connector, and more particularly to an assembly-type female connector that has good tightness for industrial use.

BACKGROUND OF THE INVENTION

The electric current for industrial use is received and transmitted via an electric cord and a plug. In other words, the electric power is supplied via a supplier (socket) and a receiver (plug). However, it is very inconvenient to utilize the plug that has a limited length if the socket of the supplier is fixed on a wall or an immovable position.

In view of this, a so-called extension cord is disclosed to extend the usable distance of the socket of the supplier. The general extension cord generally has an internal frame body having several front openings on the front side for insertion of conduction terminals of the electric appliance thereinto. The extension cord further has a back opening for insertion of the socket terminals of the female connector, which is a riveted cord, thereinto. The back opening is communicated with the front openings so that the conduction terminals of the electric appliance can be electrically connected with the socket terminals of the female connector for extending the usable distance of the female connector.

A female connector is disclosed in U.S. Pat. No. 5,234,355. The female connector comprises a main body and an outer cover, wherein the main body is covered with the outer cover after insertion of several socket terminals into the main body.

However, during the assembly process of this conventional female socket, three socket terminals must be inserted into the main body before covering the main body with the outer cover. As a result, it is very inconvenient to use, causing the increase of working time and cost.

Furthermore, the assembled female connector has poor tightness between the main body and the outer cover. Accordingly, the melted plastic materials are easily permeated into the main body during the subsequent injection-molding process. As a result, the conduction terminal cannot properly touch the terminals of the female connector, causing the poor quality and even the wastage and the increase of the production cost.

SUMMARY OF THE INVENTION

In view of the aforesaid structure that needs to be improved; a major object of the present invention is to disclose an improved structure of assembly-type female connector that utilizes at least two independent segments to form an outer cover. In addition, in the assembly process, the socket terminals can be placed in the main body, and the independent segments are then utilized to confine the socket terminals to the inside of the main body so as to completely avoid the increase of working time and cost caused by the conventional inconvenience in the assembly process.

Another object of the present invention is to disclose an improved structure of assembly-type female connector, wherein several segments are assembled closely and tightly to prevent the melted plastic materials from permeating into the main body during the subsequent injection-molding process for thereby avoiding the occurrence of poor quality to ensure that the conduction terminals can properly touch the socket terminals.

In order to achieve the above-mentioned objects, an assembly-type female connector is comprised of a group of socket terminals and an internal frame body, wherein the internal frame body comprises a main body, a lateral cover, and an outer cover. The main body has several insertion trenches on the outside with a quantity and a size corresponding to that of the socket terminals for insertion of the socket terminals thereinto. The outer cover is for covering the main body. The present invention is characterized in that at least two first slots are formed on the outside of the main body, and the outer cover is composed of at least two independent segments, wherein each segment has an inwardly extended first wall and an inwardly extended second wall corresponding to the first slots of the main body, respectively, whereby the first walls of the segments and the second walls of the segments can be tightly inserted into the first slots of the main body together so that the outer cover and the main body can be assembled to each other. In addition, the first walls of the segments and the second walls of the segments are so jointly inserted into the first slots of the main body that the integral structure has a detachable tight assemblage for increasing the product quality after the subsequent injection-molding process.

DETAILED DESCRIPTION OF THE PREFERRED EMBODIMENT

The description taken with the drawings make the structures, features, and embodiments of the present invention apparent to those skilled in the art how the present invention may be embodied in practice.

Figure 1:
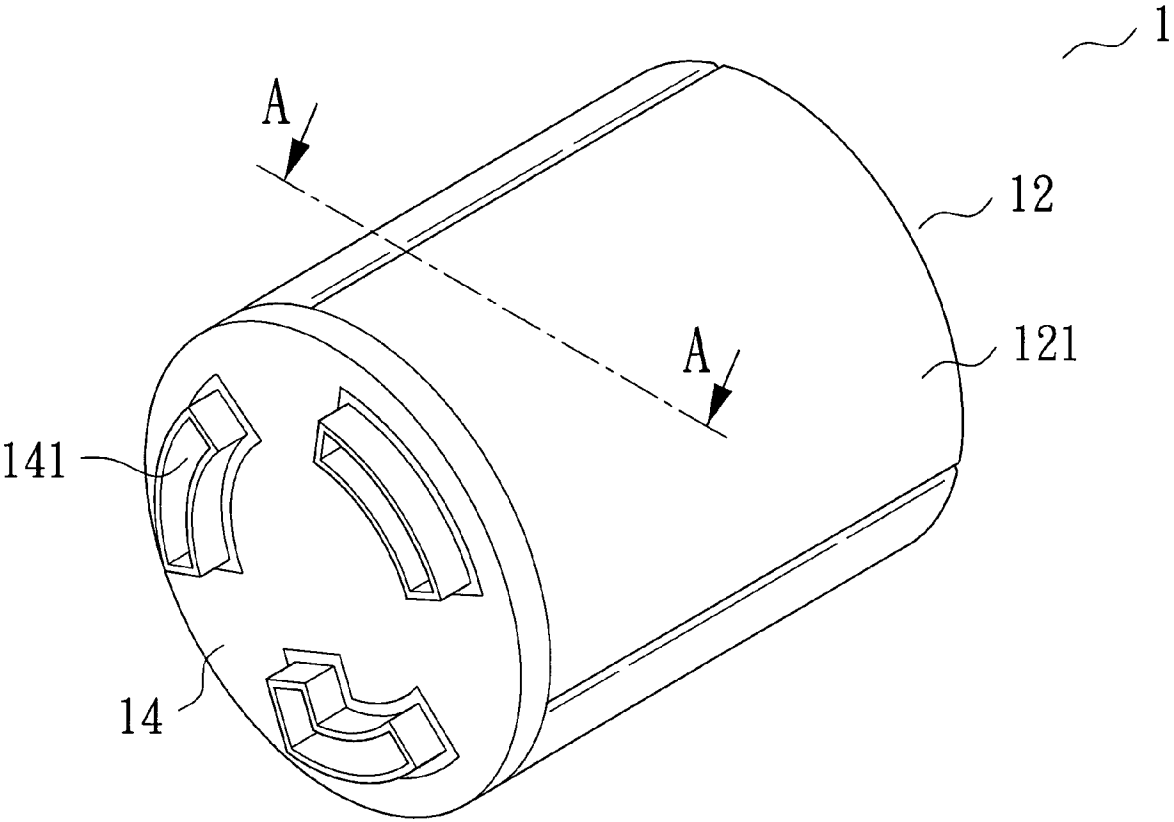
FIG. 1 is an elevational diagram of the present invention.
Figure 2:
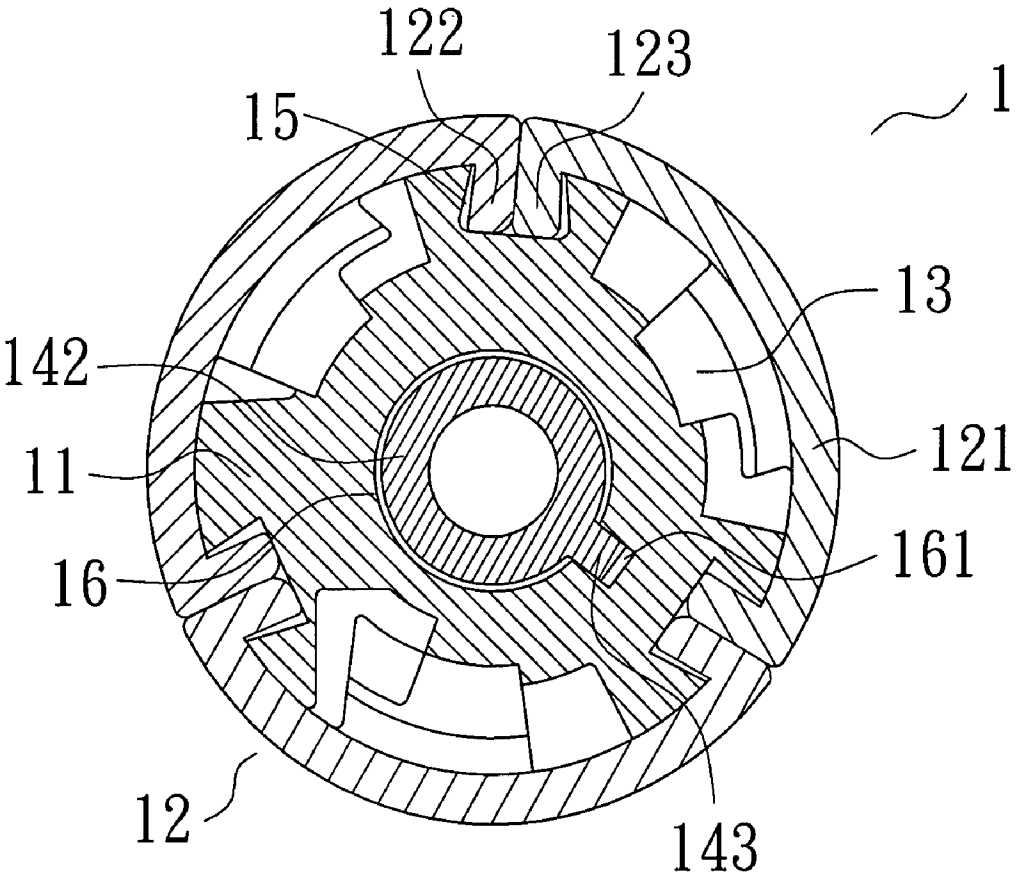
FIG. 2 is a cross-sectional view taken along a line A-A in FIG. 1.
Figure 3:
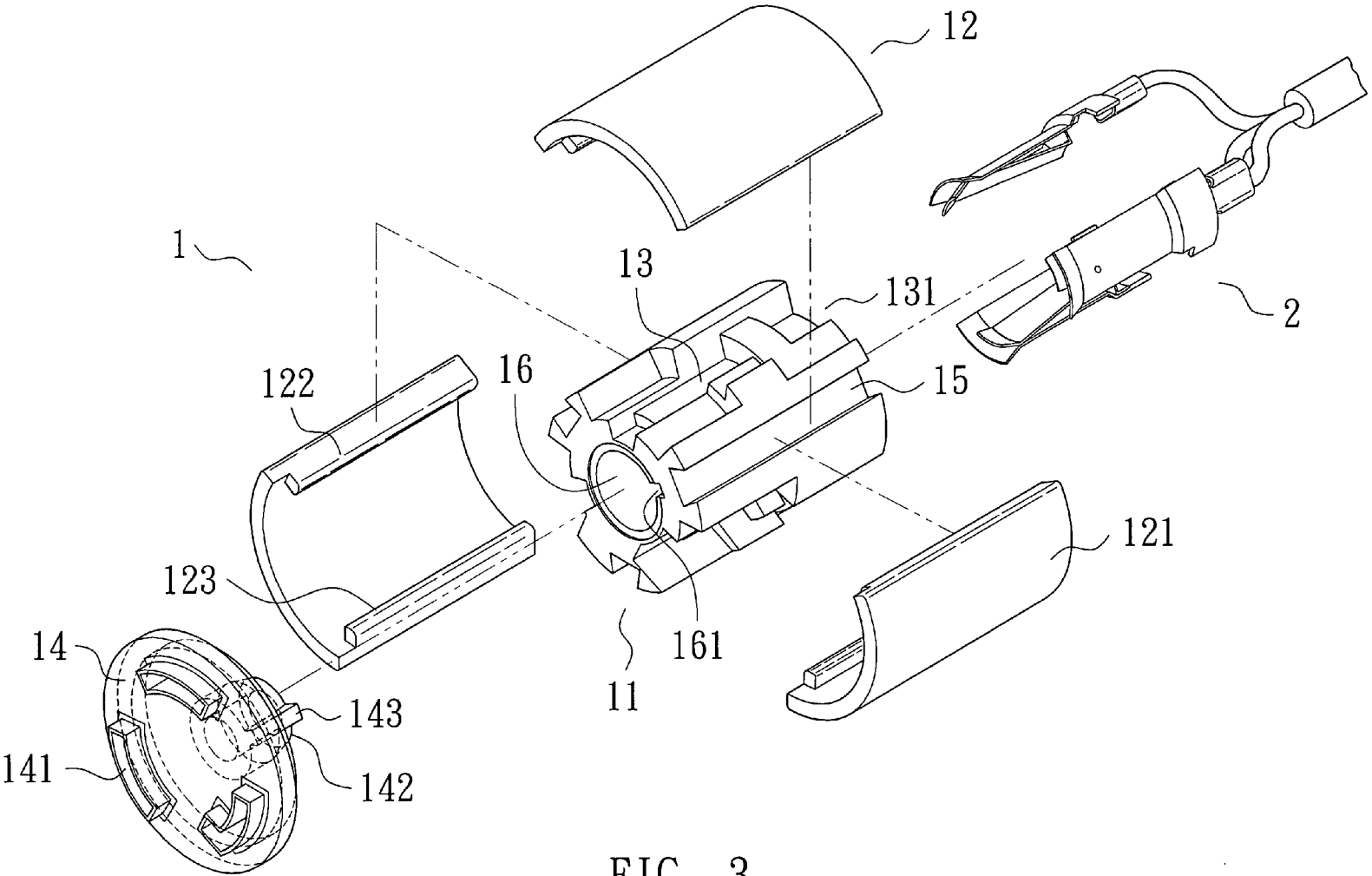
FIG. 3 is an elevational, decomposed view showing the internal frame body and the socket terminals of the present invention.

Referring to FIG. 1 through FIG. 3, an improved structure of assembly-type female connector of the present invention generally comprises an internal frame body 1 and a group of socket terminals 2, wherein the internal frame body 1 at least comprises a main body 11 and an outer cover 12. The main body 11 has several insertion trenches 13 on the outside with a quantity and a size corresponding to that of the socket terminals 2 for insertion of the socket terminals 2 thereinto. In addition, the main body 11 has a lateral cover 14 for covering lateral openings 131 of the insertion trenches 13, and the lateral cover 14 has insertion holes 141 respectively corresponding to the lateral openings 131 of the insertion trenches 13 to allow several conduction terminals (not shown) that insert thereinto to properly touch the socket terminals 2 inside the insertion trenches 13. The outer cover 12 is for covering the main body 11 to prevent the melted plastic materials from permeating into the main body 11 during the subsequent injection-molding process for thereby avoiding the occurrence of poor quality.

It is worthy to note that the main body 11 has three first slots 15 on the outside, and the outer cover 12 is composed of three independent segments 121, wherein each segment 121 has an inwardly extended first wall 122 and an inwardly extended second wall 123 corresponding to the longitudinal first slots 15, respectively. The first wall 122 of one segment 121 and the second wall 123 of another segment 121 can be tightly inserted into the first slot 15 together so that the outer cover 12 can be assembled to the main body 11. In addition, the first walls 122 of the segments 121 and the second walls 123 of the segments 121 are so jointly inserted into the first slots 15 of the main body 11 that the integral structure has a detachable tight assemblage for increasing the product quality after the subsequent injection-molding process. Furthermore, the segments 121 of the outer cover 12 have a quantity corresponding to that of the first slots 15 of the main body 11.

Referring to FIG. 1 through FIG. 3 again, the main body 11 has a tunnel 16 on the edge to which the lateral cover 14 is attached. The tunnel 16 has a second slot 161 on the wall. The lateral cover 14 has a pillar 142 for insertion into the tunnel 16 of the main body 11, wherein the pillar 142 has a raised block 143 on the outside for insertion into the second slot 161. In addition, the raised block 143 has a width value slightly larger than that of the second slot 161. In addition, the raised block 143 and the main body 11 are made of proper materials so that the raised block 143 of the lateral cover 14 can be pressed into the second slot 161 of the main body 11 and positioned therein for preventing the lateral cover 14 from being unfastened by the temperature and the pressure in the subsequent injection-molding process. In other words, after the lateral cover 14 is attached to the main body 11, the lateral openings 131 of the insertion trenches 13 of the main body 11 are located to aim at the insertion holes 141 of the lateral cover 14 to ensure that the conduction terminals can properly touch the socket terminals 2 for improving the stability of quality.

Figure 4:
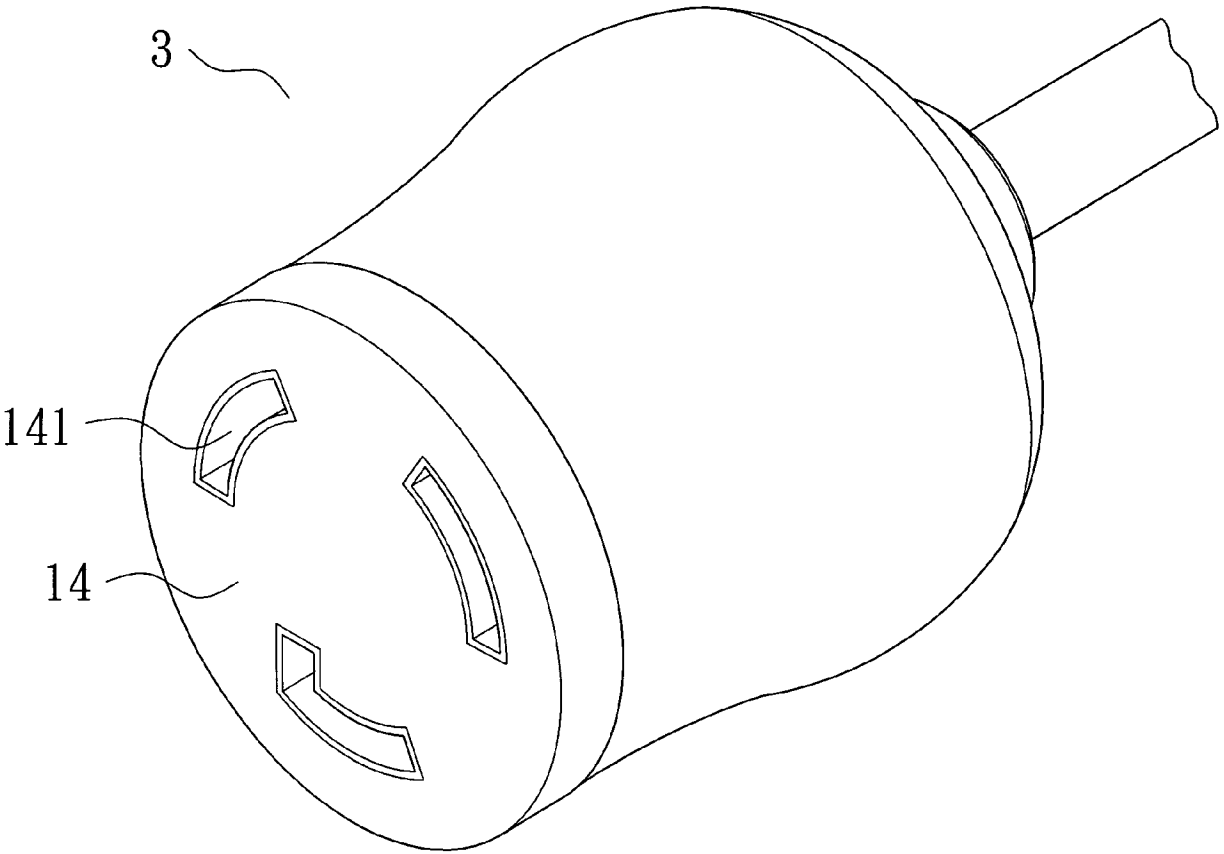
FIG. 4 is an elevational view showing the assembly-type female connector of the present invention.

Referring to FIG. 4, the assembled female connector product 3 of the present invention, which is processed by the subsequent injection-molding process, is shown.

The present invention has the following advantages:

1. The outer cover of the present invention is composed of at least two independent segments. In addition, the socket terminals can be first placed inside the main body, and the independent segments are then utilized to confine the socket terminals to the inside of the main body so as to completely avoid the increase of working time and cost caused by the conventional inconvenience in the assembly process.

2. The outer cover of the present invention is detachably composed of several segments so that the socket terminals can be fixedly positioned in the insertion trenches of the main body. As a result, the product quality of the present invention is completely not affected by the temperature and pressure in the subsequent injection-molding process.

3. The internal frame body and the socket terminals of the present invention can be assembled and positioned tightly to avoid the phenomenon of displacement caused by the temperature and pressure in the subsequent injection-molding process for assuring the yield of the product and thereby conforming to the safety regulations.

4. The main body has the second slot so that the pillar of the lateral cover can be fixedly positioned on the main body and that the lateral openings of the insertion trenches of the main body can be located to aim at the insertion holes of the lateral cover to ensure that the conduction terminals can properly touch the socket terminals for improving the stability of quality.

5. The main body, the outer cover, and the lateral cover can be tightly and closely assembled together to prevent the melted plastic materials from permeating into the main body during the subsequent injection-molding process for thereby avoiding the occurrence of poor quality.

On the basis of the description mentioned above, the present invention indeed satisfies the requirements for patentability since it provides practicability and has never been published or used publicly. Therefore, it is submitted for a patent.

With the invention thus explained, it is apparent that various modifications and variations can be made without departing from the scope of the invention. It is therefore intended that this invention be limited only as indicated in the appended claims.

The invention claimed is:

1. An assembly-type female connector comprising:

a group of socket terminals; and an internal frame body comprising a main body having a plurality of insertion trenches on the outside with a quantity and a size corresponding to that of said socket terminals for insertion of said socket terminals thereinto and an outer cover for covering said main body, characterized in that:

at least two first slots are formed on the outside of said main body;

said outer cover is composed of at least two independent segments, wherein each segment has an inwardly extended first wall and an inwardly extended second wall for insertion into said first slots of said main body, respectively, whereby said first walls of said segments and said second walls of said segments can be jointly, tightly inserted into said first slots of said main body so that said outer cover can be assembled to said main body.

2. An assembly-type female connector of claim 1, wherein said segments of said outer cover have a quantity corresponding to that of said first slots of said main body.

3. An assembly-type female connector of claim 1, wherein said main body has a lateral cover for covering lateral openings of said insertion trenches, and said lateral cover has insertion holes respectively corresponding to said lateral openings of said insertion trenches to allow conduction terminals that insert thereinto to properly touch said socket terminals inside said insertion trenches.

4. An assembly-type female connector of claim 3, wherein said main body has a tunnel on the edge to which said lateral cover is attached, said tunnel has a second slot on the wall, and said lateral cover has a pillar for insertion into said tunnel of said main body, wherein said pillar has a raised block on the outside for insertion into said second slot.

5. An assembly-type female connector of claim 4, wherein said raised block has a width value slightly larger than that of said second slot, and said raised block and said main body are made of proper materials to allow said raised block of said lateral cover to be pressed into said second slot of said main body and positioned therein.

* * * * *